US007104785B2

(12) United States Patent
Feaser

(10) Patent No.: US 7,104,785 B2
(45) Date of Patent: Sep. 12, 2006

(54) CANDLEWICK TRIMMER

(76) Inventor: Wendy S. Feaser, 501 Hockersville Rd., Hershey, PA (US) 17033

( * ) Notice: Subject to any disclaimer, the term of this patent is extended or adjusted under 35 U.S.C. 154(b) by 0 days.

(21) Appl. No.: 11/353,715

(22) Filed: Feb. 14, 2006

(65) Prior Publication Data

US 2006/0134570 A1 Jun. 22, 2006

Related U.S. Application Data

(63) Continuation-in-part of application No. 10/819,660, filed on Apr. 7, 2004, now abandoned.

(51) Int. Cl.
*F23D 3/28* (2006.01)
*F23Q 2/32* (2006.01)
*A01D 1/00* (2006.01)

(52) U.S. Cl. ..... 431/120; 431/253; 30/278

(58) Field of Classification Search ..... 431/120, 431/253; 30/278–285
See application file for complete search history.

(56) References Cited

U.S. PATENT DOCUMENTS

| | | | | |
|---|---|---|---|---|
| D157,245 | S | 2/1950 | Egle | |
| 3,985,492 | A | 10/1976 | Nunemaker | |
| D270,952 | S | 10/1983 | Peterson | |
| 4,426,778 | A | 1/1984 | Christie | |
| 4,897,033 | A | 1/1990 | Yang | |
| D330,784 | S | 11/1992 | Zuffoletti | |
| 5,300,083 | A | 4/1994 | Lin et al. | |
| 5,829,965 | A | 11/1998 | Rubalcava | |
| 6,209,207 | B1 | 4/2001 | Patterson et al. | |
| 6,243,954 | B1 | 6/2001 | Bowers | |
| 6,295,991 | B1 | 10/2001 | Emery | |
| 6,405,441 | B1 | 6/2002 | Rucker | |
| 6,527,545 | B1 | 3/2003 | Cook | |
| 6,619,950 | B1 | 9/2003 | Ricci | |
| 6,655,031 | B1 | 12/2003 | Grant et al. | |
| 2002/0031738 | A1 | 3/2002 | Ricci | |
| 2003/0062055 | A1 | 4/2003 | Park | |
| 2003/0134243 | A1 | 7/2003 | Cohen | |
| 2005/0039335 | A1 | 2/2005 | Forsberg et al. | |
| 2005/0227191 | A1 * | 10/2005 | Feaser | 431/120 |

* cited by examiner

*Primary Examiner*—Alfred Basichas
(74) *Attorney, Agent, or Firm*—Hooker & Habib, P.C.

(57) ABSTRACT

A candlewick trimmer includes an elongate housing and a lever pivotally mounting to the housing. The lever includes a cutter extending from the pivot having a cutting edge to cut off a candlewick inserted into the housing and a cam surface spaced from the cutting edge. The cam surface engages the candlewick a predetermined distance beyond the cutting edge and deflects the candlewick towards an opening in the housing.

15 Claims, 4 Drawing Sheets

CANDLEWICK TRIMMER

This application is a Continuation-In-Part of U.S. patent application Ser. No. 10/819,660 filed Apr. 7, 2004 now abandoned.

FIELD OF THE INVENTION

The invention relates to a cutting tool, particularly a cutting tool for trimming candlewicks.

DESCRIPTION OF THE PRIOR ART

Candles have become fashionable home accessories. A candle flame provides a relaxing and calming environment, and burning a scented candle contributes a pleasing fragrance to the experience.

Popular types of candles include jar candles (including votives), in which the candle wax is poured into a glass jar or container. The candle burns down into the jar. Other popular types of candles include pillar candles having multiple wicks, in which each candle flame forms its own "well" or depression in the candle wax.

Candles may be supplied new with wicks having free ends that extend many inches from the end of the candle. The free end of the wick must be trimmed before the candle can be used. It is also good practice to re-trim candlewicks to maintain a length of about an eighth-inch to about a quarter-inch for burning. A candle will burn slowly and have a long life if the candlewick is re-trimmed occasionally after its initial trimming. A candle with too-long a wick burns with a large, smoky flame. The large flame consumes the candle quickly, and smoke discolors walls and ceilings. A large flame also burns scent rather than allowing the candle to release scent into the room.

Candlewick trimmers are cutting tools specifically designed for trimming or re-trimming candlewicks. Candlewick trimmers may be combined with other candle tools, such as a snuffer or lighter, to form a combination candle maintenance tool that lights, trims, and snuffs candles. Consumers appreciate the convenience of such combination candle maintenance tools.

One common type of candlewick trimmer is formed from two flat plates. One plate has a through-hole that receives the wick. The other plate is movably mounted on the one plate and has a cutting edge. The cutting edge passes over the through-hole to cut the wick. Such candlewick trimmers are used for trimming the wicks of new candles and re-trimming wicks after burning.

Although plate-type candlewick trimmers are useful tools, they have difficulty re-trimming jar candles and multiple-wick candles. The jar or the top of the candle well prevents the candlewick trimmer from reaching the wick, or prevents the trimmer from being held perpendicular to the wick for a proper cut. Even if the wick can be reached, the length of the cut is gauged by eye and the wick may be cut too long or too short.

Christie, U.S. Pat. No. 4,426,778 discloses a wire stripper tool that does not use flat plates. The tool includes a tubular body with a central longitudinal passage that receives wire at one end of the body for the stripping application. A knife blade is fixed on an elongated lever arm pivotally mounted on top of the body. The length of the cable stripped by the tool is set by an adjustable gauge rod in the central passage.

Although the body of the Christie tool could be sized to enable the body to fit into candle jars and candle wells, the Christie tool has disadvantages if modified for use as a candlewick trimmer. The gauge rod limits the length of wick that can be received in the trimmer, and long wicks would require several cuts to be trimmed to proper length. Removing the gauge rod would enable a long wick to extend out the other end of the tool and be trimmed with a single cut. However, this requires both ends of the body to be open and unblocked, and so limits the ability of the tool to be used in all-in-one candle maintenance tools.

Hence there is a need for an improved candlewick trimmer for use with jar candles and multiple-wick candles that cuts the wick to proper length. The improved candlewick trimmer should also enable long wicks found on new, unburned candles to be quickly trimmed to length, and should be readily adapted for use in all-in-one candle maintenance tools.

SUMMARY OF THE INVENTION

The present invention is an improved candlewick trimmer for use with jar candles and multiple-wick candles. The trimmer cuts the wick to proper length when pressed against the candle. The trimmer also enables long wicks to be quickly trimmed to length and is readily adapted for use in all-in-one candle maintenance tools.

A candlewick trimmer in accordance with the present invention includes an elongate housing defining a longitudinal passage, and a lever pivotally mounting in the passage. The lever includes a cutter extending from the pivot having a cutting edge spaced from one end of the housing and a cam surface facing the one end of the housing. The cam surface is configured to direct the excess length of wick to be trimmed toward an opening in the housing. An actuator or trigger outside of the housing is connected to the lever (or preferably forms part of the lever) and moves the cutting edge across the opening to cut the wick.

The end of the trimmer is preferably sized to fit into candle jars and candle wells. The length of the trimmed candlewick is determined by the predetermined distance of the cutting edge from the housing end.

In use, the housing is pressed against the candle. The free end of the candlewick extends through the opening and into the interior of the housing. The surface of the opening preferably centers the wick in the housing. Excess length of candlewick is directed by the cam surface towards the housing and exits the housing through the opening. Squeezing the actuator moves the cutting edge across the opening and cuts the wick to proper length.

In preferred embodiments the cam surface is spaced about a quarter-inch from the cutting blade. If the end of the candlewick is held against the cam surface, the trimmer cuts off a quarter-inch length of wick. This enables the trimmer to cut off a predetermined length from the free end of the candlewick without pressing the trimmer against the candle, an added advantage of the present invention.

Although the candlewick trimmer of the present invention is preferably sized for use with jar candles and multiple-wick candles, the trimmer can also be used to trim the wick of most any other type or style of candle.

In yet other possible embodiments of the present invention the candlewick trimmer can be included with a lighter and a candle tool, such as a candle snuffer or wick manipulation tool, to form a combination candle maintenance tool. Because the other end of the housing can be closed or blocked, the housing can butt up against another component (for example, the trigger guard of a lighter) without affecting functionality of the trimmer.

In further embodiments of the present invention the candlewick trimmer can be removably mounted on a conventional lighter having an elongate barrel. This enables disposable lighters to be used in forming a combination candle tool by merely moving the candlewick trimmer to another lighter when the lighter runs out of fuel.

The candlewick trimmer of the present invention has a number of advantages over conventional candlewick trimmers. The trimmer readily trims the wicks of jar candles and multiple-wick candles, and cuts the wick to proper length by merely pressing the end of the trimmer against the candle. The trimmer housing can be readily mounted on other candle tools or candle lighters to form combination candle maintenance tools. And the trimmer can trim the wicks of many other types and styles of candles, and can trim a pre-determined length of candlewick without pressing the trimmer against the candle.

Other objects and features of the invention will become apparent as the description proceeds, especially when taken in conjunction with the accompanying three drawing sheets illustrating three embodiments of the invention.

DESCRIPTION OF THE PREFERRED EMBODIMENTS

Figure 1:
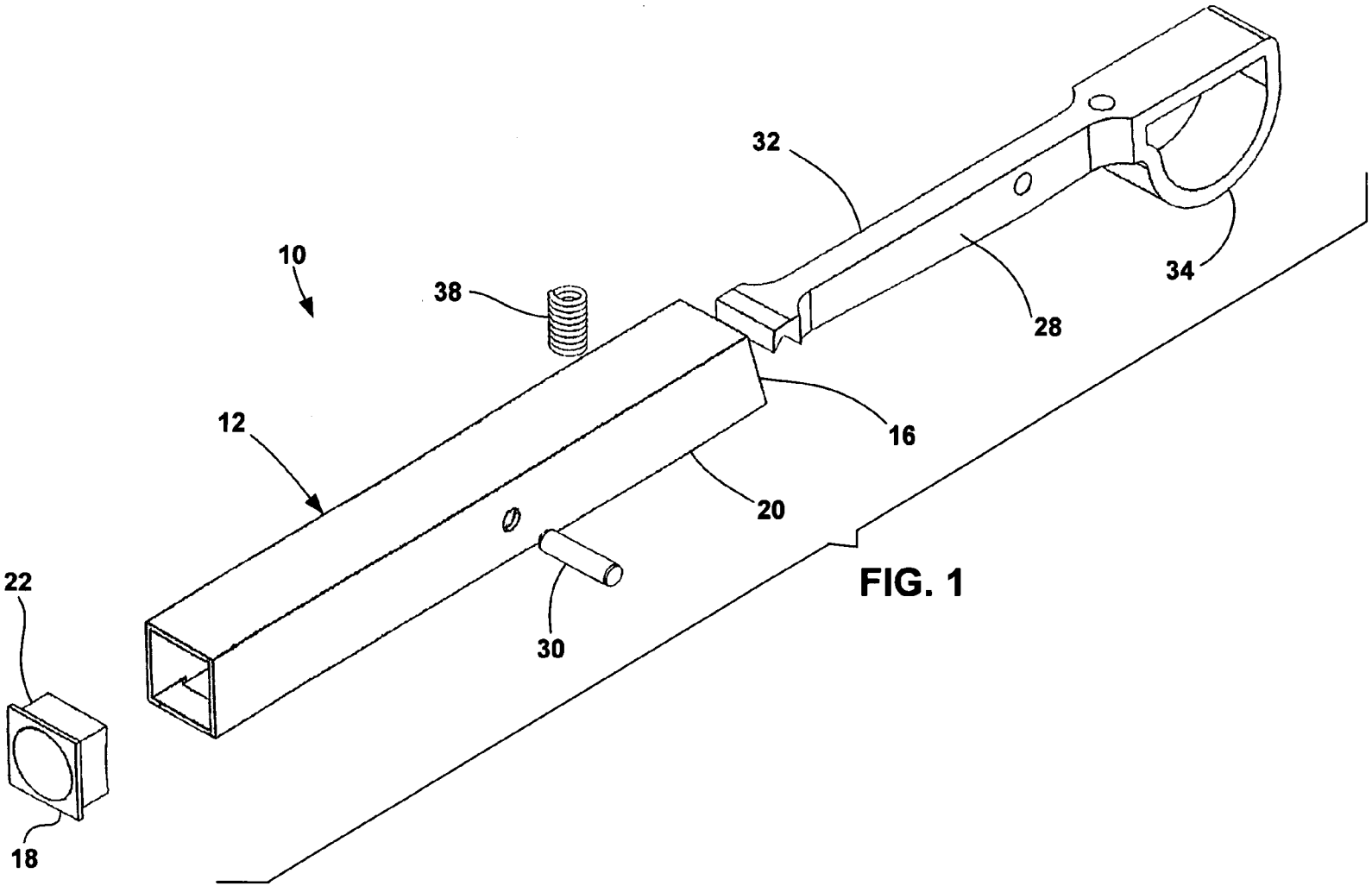
FIG. 1 is an exploded view of a first embodiment candlewick trimmer in accordance with the present invention.
Figure 2:
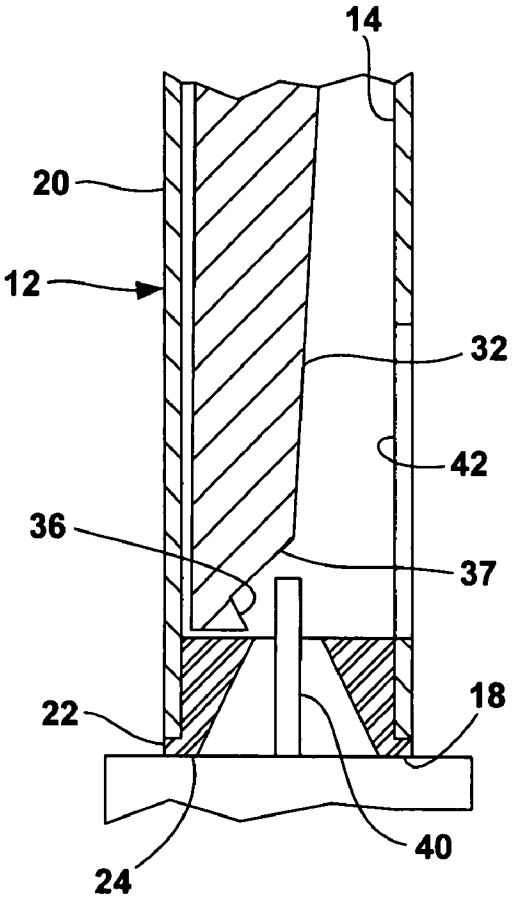
FIG. 2 is a partial sectional side view of the candlewick trimmer shown in FIG. 1 and illustrating the trimmer receiving a candlewick for trimming.

FIGS. 1 and 2 illustrate a first-embodiment candlewick trimmer 10 in accordance with the present invention. Trimmer 10 includes a housing 12 defining an interior volume 14. Housing 12 has axially-opposed ends 16, 18 and includes an elongate, generally tubular member 20 extending from end 16. A plug member 22 fits in tubular member 20 and closes the end of the tubular member adjacent end 18. Plug member 22 includes a transverse outer face 24 and a conical, axial through-bore 26 extending from face 24 to receive a free end of a candlewick into the housing interior.

A lever 28 is pivotally mounted to the housing 12 by a pivot pin 30 journaled in tubular member 16. Lever 28 includes a cutter 32 in the housing extending from the pivot pin towards the plug member 22, and an actuator 34 outside of the housing adjacent housing end 16. Cutter 32 has a cutting edge 36 closely spaced from plug member 22 and a cam surface 37 facing the opening. A helical coil spring 38 is compressed between the housing and the lever. Spring 38 urges the lever 28 to a first operating position shown in FIG. 2.

In use, housing 12 is axially-aligned with a candlewick 40. Plug 22 is placed against the candle, with the wick extending through bore 26 and into the housing. The illustrated tubular member 20 and plug 22 have a generally square cross-section with about one-half inch sides. This enables trimmer 10 to extend into most candle jars or wells of pillar candles to reach the wick. Other cross-section shapes and sizes can be used.

The conical surface of the bore 26 assists in guiding and centering the wick within the housing. Squeezing actuator 34 rotates the lever counterclockwise as viewed in FIG. 2 to a second position. Cutting edge 36 moves across the opening to effect cutoff of the wick. A slot 42 in the housing allows the cutoff portion to fall out of the housing. If desired a removable cover or movable panel could close the slot for later disposal. Spring 38 returns the lever to the first operating position when the actuator is released.

FIG. 2 illustrates end 18 of trimmer 10 pressed against the end of a candle 44. The length of the trimmed candlewick is therefore established by the distance of cutting edge 36 from end 18. Preferred embodiments of the illustrated trimmer 10 trim the wick to a length of between about one-eighth inch and about one-quarter inch. Different removable plug members 22 could be provided to extend end 18 away from the cutter for longer cuts, or the dimensions of the plug 22 and the spacing of the cutting edge 36 from the adjacent end of the tubular member 20 can be modified for different trim lengths.

Figure 3:
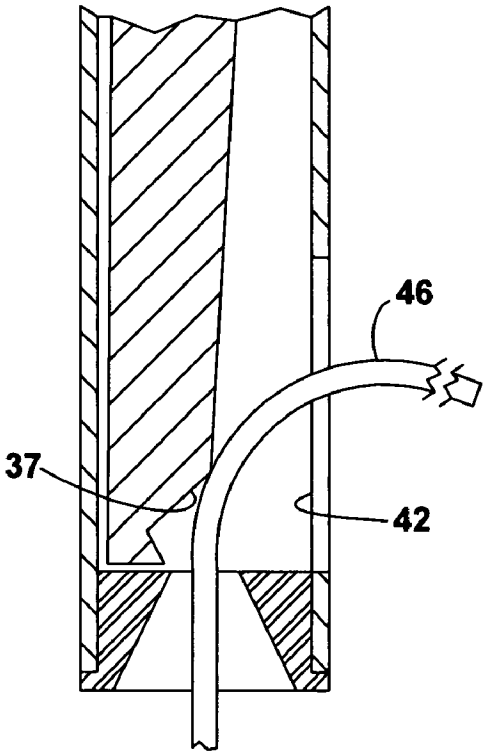
FIG. 3 is a view similar to FIG. 2 but illustrating the candlewick trimmer receiving a long candlewick for trimming.

FIG. 3 illustrates candlewick trimmer 10 trimming a candlewick 46 whose length is greater than the length of trimmer 10. Cam surface 37 is inclined with respect to the longitudinal axis of the housing 20 to also face slot 42. Cam surface 37 engages and deflects the free end of the candlewick 46 towards and through slot 42 as shown when lever 28 is in the first operating position as shown in the figure. The candlewick 46 emerges from the housing 20 before reaching the opposite end 16 of the trimmer and before the candlewick would have been otherwise blocked by lever 28 or pivot pin 30.

Figure 4:
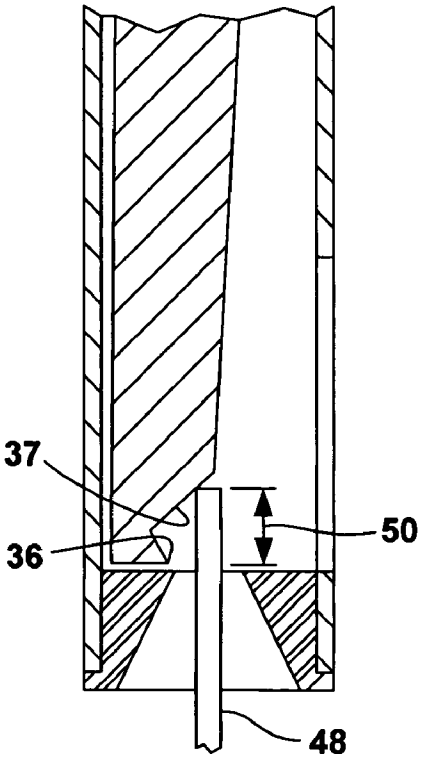
FIG. 4 is a view similar to FIG. 2 but illustrating the candlewick trimmer trimming a predetermined length from the free end of a candlewick.

FIG. 4 illustrates candlewick trimmer 10 trimming the free end of a candlewick 48 without pressing the trimmer 10 against the candle. The candlewick 48 enters the trimmer and abuts against cam surface 37. The distance 50 from cutter 36 to the abutment establishes how much of the candlewick is trimmed by abutting the wick against surface 37, preferably about one-quarter inch. This enables a predetermined length 50 of candlewick to be trimmed.

In the illustrated embodiment actuator 34 is located on the opposite side of pivot pin 30 from cutting edge 36. In other possible embodiments actuator 34 can be located on the same side of the pivot pin as cutting edge 36. In such embodiments actuator 34 could extend through an additional opening or slot in a side of tubular member 20.

Figure 5:
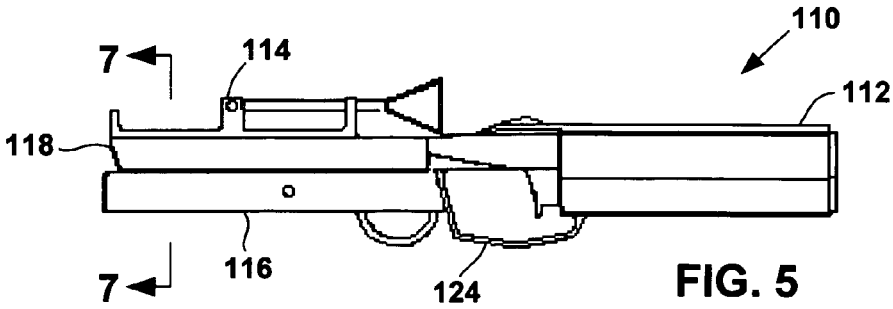
FIG. 5 is a combination candle tool in accordance with the present invention, the tool including a lighter and a candlewick trimmer removably mounted on the lighter.

FIG. 5 illustrates a combination candle maintenance tool 110 that includes a conventional butane lighter 112, a candle tool 114 and candlewick trimmer 116 otherwise identical to candlewick trimmer 10. Candlewick trimmer 116 is removably mounted to lighter 112 by a tubular adaptor 118. Trimmer 116 is attached to adaptor 118 by adhesive, screws, rivets, or other conventional attachment structure. The front of the candlewick trimmer 116 preferably extends beyond the front of the lighter 112 as shown.

Figure 6:
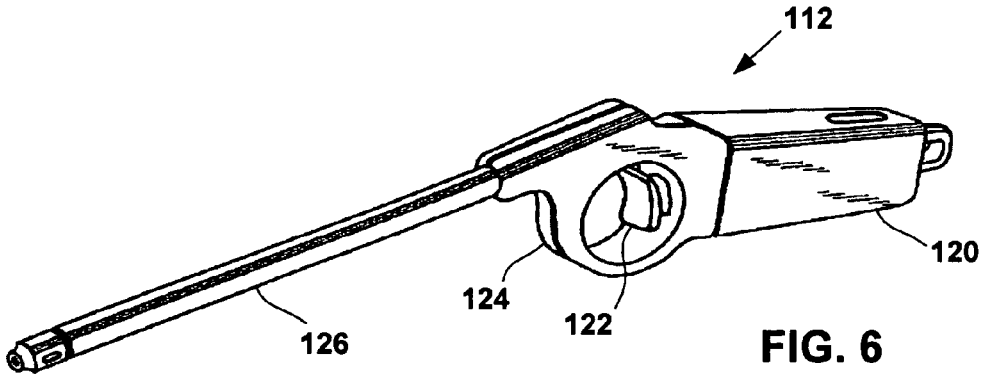
FIG. 6 (PRIOR ART)
FIG. 6 is a prior art lighter that can be adapted for use in the combination candle tool shown in FIG. 5.

FIG. 6 illustrates prior art lighter 112 that can be adapted for use in the present invention and disclosed in Ferrara, Jr. U.S. Pat. D0386045 that issued Nov. 17, 1999. Butane lighter 112 is a pistol-shaped lighter having a handle portion 120, actuating trigger 122, trigger guard 124, and an elongate tube 126 that spaces the lighter flame away from the handle.

Figure 7:
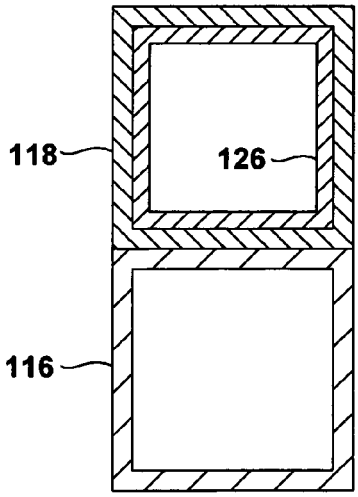
FIG. 7 is a sectional view taken along line 7—7 of FIG. 5.

FIG. 7 illustrates tubular adapter 118 removably mounting trimmer 116 to the lighter 112 (for clarity, tool 114 and the other component parts of trimmer 116 are omitted from the drawing). The adaptor 118 snugly receives tube 126 to mount the trimmer to the lighter 112 by a friction fit. If desired, one or more resilient members like an O-ring or rubber gasket can be carried in the adapter bore to form a compression fit between the adapter and lighter, or adapter 118 can be provided with a setscrew to bear against the lighter tube.

As shown in FIG. 5, end 16 of trimmer 116 is flush against lighter trigger guard 124. Such construction is possible without limiting the functionality of trimmer 116 because cam surface 37 deflects a long candlewick out of the housing through opening 42 as previously described without requiring that the candlewick emerge from trimmer end 16. Candle tool 114, formed as a candle snuffer, is pivotally mounted on adapter 118.

In alternative embodiments tubular adapter 118 can be eliminated and spring clips, threaded fasteners, or other mounting devices can be used to removably mount trimmer 116 to lighter 112.

Trimmer 116 and lighter 112 have separate and independently operable actuators to trim and light the candle. In other embodiments trimmer 116 and lighter 112 could be simultaneously operated by a single actuator or trigger.

Figure 8:
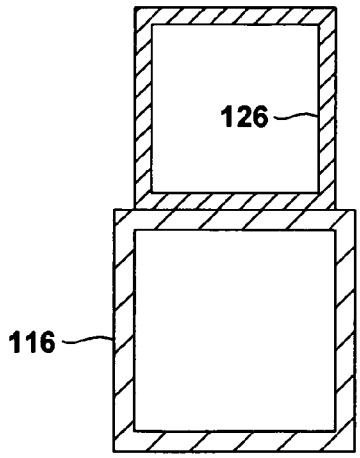
FIG. 8 is a sectional view similar to that of FIG. 7 but of a second combination candle tool in which the candlewick trimmer is permanently attached to the lighter.
Figure 9:
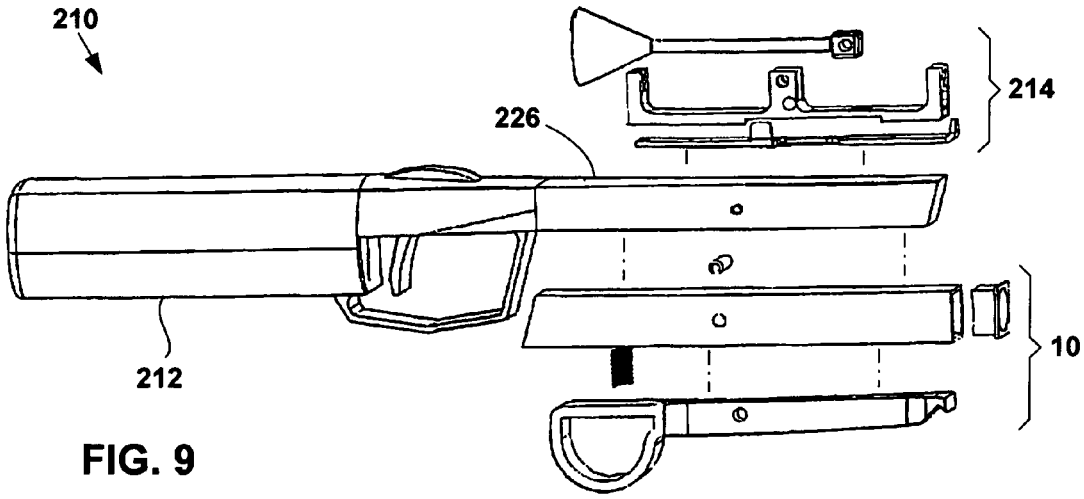
FIG. 9 is an exploded view of the combination candle tool shown in FIG. 8.

FIGS. 8 and 9 illustrate an alternative embodiment combination candle tool 210 similar to that shown in FIG. 5 but with the candlewick trimmer 10 permanently attached to the tube 226 of a refillable butane lighter 212. Trimmer 10 can be attached by screws, rivets, adhesives, or other conventional attachment structures. Candle tool 214, like candle tool 114, is mounted on lighter tube 226 by screws.

In yet other embodiments the candle tool can be mounted on the candlewick trimmer. Other or additional types or forms of candle tool 114 or 214 can be provided, including wick manipulation tools or other types of wick trimmers.

While I have illustrated and described preferred embodiments of my invention, it is understood that this is capable of modification, and I therefore do not wish to be limited to the precise details set forth, but desire to avail myself of such changes and alterations as fall within the purview of the following claims.

I claim:

1. A combination candle tool comprising:

a lighter and a candlewick trimmer;

the candlewick trimmer comprising a housing defining an interior, a lever, an actuator operatively connected to the lever, a pivot connection mounting the lever to the housing, the lever pivotable about a pivot axis for relative motion between first and second operating positions, the actuator being arranged to receive a force urging the lever towards the second operating position;

the housing comprising an elongate tubular portion comprising axially spaced first and second ends, and an opening at the first end to receive the free end of a candlewick inserted into the housing interior;

the lever comprising a cutter extending from the pivot axis towards the first end, the cutter comprising a cutting edge adjacent the opening, the cutting edge movable to effect cutoff of a wick inserted into the housing when the lever is moved from the first position to the second position; and means for removably mounting the housing on the lighter.

2. The combination lighter and candlewick trimmer of claim 1 wherein the mounting means comprises a tubular adapter that receives a portion of the lighter.

3. A candlewick trimmer comprising:

a housing defining an interior, a lever, an actuator operatively connected to the lever, a pivot connection mounting the lever to the housing, the lever pivotable about a pivot axis for relative motion between first and second operating positions, the actuator being arranged to receive a force urging the lever towards the second operating position;

the housing comprising an elongate tubular portion comprising axially spaced first and second ends, and an opening at the first end to receive the free end of a candlewick inserted into the housing interior;

the lever comprising a cutter extending from the pivot axis towards the first end, the cutter comprising a cutting edge adjacent the opening and a cam surface spaced from the cutter away from the opening, the cam surface disposed to face the opening and engage the end of a candlewick inserted into the opening when the lever is in the first position, the cutting edge movable to effect cutoff of a wick inserted into the housing when the lever is moved from the first position to the second position;

whereby the cutter trims a predetermined length of wick from the free end of a candlewick abutting the cam surface.

4. The candlewick trimmer of claim 3 wherein the housing extends along a longitudinal axis and the cam surface is inclined with respect to the longitudinal axis to deflect the free end of a candlewick inserted into the trimmer away from the axis.

5. The candlewick trimmer of claim 4 including an additional opening in the housing, the cam surface arranged to deflect the free end of a candlewick inserted into the trimmer towards the additional opening.

6. The candlewick trimmer of claim 5 wherein the additional opening is disposed between the first end of the housing and the pivot axis.

7. The candlewick trimmer of claim 3 including a spring urging the lever towards the first operating position.

8. The candlewick trimmer of claim 3 wherein the cam surface is spaced not more than one-quarter inch from the cutter edge.

9. A candlewick trimmer comprising:

a housing defining an interior, the housing comprising first and second ends, a opening at the first end to receive the free end of a candlewick inserted into the housing, and a second opening between the first and second ends;

a lever, an actuator operatively connected to the lever, a pivot connection mounting the lever to the housing, the lever pivotable about a pivot axis for relative motion between first and second operating positions, the actuator being arranged to receive a force urging the lever towards the second operating position;

the lever comprising a cutter extending from the pivot axis towards the first end, the cutter comprising a cutting edge adjacent the first opening and a the lever comprising a cutter extending from the pivot axis towards the first end, the cutter comprising a cutting edge adjacent the opening and a cam surface spaced from the cutter away from the first opening, the cutting edge movable to effect cutoff of a wick inserted into the housing when the lever is moved from the first position to the second position;

the cam surface arranged to engage the free end of a candlewick inserted into the housing and to deflect the end of the candlewick towards the second opening when the lever is in the first operating position whereby the free end of a candlewick can emerge from the housing through the second opening prior to being cut by the cutter.

10. The candlewick trimmer of claim 9 wherein the cam surface faces the first and second openings when the lever is in the first operating position.

11. The candlewick trimmer of claim 9 wherein the cam surface is a planar surface.

12. The candlewick trimmer of claim 9 wherein the cam surface is spaced from the cutter edge such that a candlewick extends no more than one-quarter inch beyond the cutter edge when the free end of the candlewick engages the cam surface.

13. The candlewick trimmer of claim 9 in combination with a lighter, the candlewick trimmer attached to the lighter.

14. The candlewick trimmer of claim 13 wherein the second end of the housing is immediately adjacent a portion of the lighter.

15. The candlewick trimmer of claim 14 wherein the second end of the housing is immediately adjacent a trigger guard of the lighter.

* * * * *